US012396540B2

(12) United States Patent
Cahill

(10) Patent No.: US 12,396,540 B2
(45) Date of Patent: Aug. 26, 2025

(54) HAIR TREATMENT SYSTEM

(71) Applicant: BG4 LLC, Fort Collins, CO (US)

(72) Inventor: Melany Anne Cahill, Fort Collins, CO (US)

(73) Assignee: BG4 LLC, Fort Collins, CO (US)

( * ) Notice: Subject to any disclaimer, the term of this patent is extended or adjusted under 35 U.S.C. 154(b) by 0 days.

(21) Appl. No.: 17/723,208

(22) Filed: Apr. 18, 2022

(65) Prior Publication Data

US 2022/0232941 A1 Jul. 28, 2022

Related U.S. Application Data

(63) Continuation of application No. 15/487,848, filed on Apr. 14, 2017, now Pat. No. 11,324,298.

(51) Int. Cl.
*A45D 19/00* (2006.01)
*A45D 44/12* (2006.01)

(52) U.S. Cl.
CPC ..... *A45D 19/00* (2013.01); *A45D 44/12* (2013.01); *A45D 19/0066* (2021.01)

(58) Field of Classification Search
CPC .... A45D 19/00; A45D 19/012; A45D 19/016; A45D 19/018; A45D 19/0083; A45D 19/0075; A45D 19/0066; A45D 19/0041; A45D 44/12; A45D 44/08; A45D 8/36; A45D 8/001; A45D 7/04; A45D 7/045; A45D 7/06; A45D 7/065; A42C 5/02; A42C 5/04; A42B 1/002
See application file for complete search history.

(56) References Cited

U.S. PATENT DOCUMENTS

| | | | | |
|---|---|---|---|---|
| 1,764,912 A | | 6/1930 | Caster-Udell | |
| 1,905,370 A | | 4/1933 | Dorsey et al. | |
| 2,023,279 A | | 12/1935 | McNutt | |
| 2,032,898 A | | 3/1936 | Wilson | |
| 2,033,691 A | * | 3/1936 | Douglass | A61F 9/026 2/206 |
| 2,162,608 A | | 6/1939 | Davis | |
| 2,211,184 A | * | 8/1940 | Varell | A42B 1/041 D2/871 |

(Continued)

FOREIGN PATENT DOCUMENTS

| | | | |
|---|---|---|---|
| GB | 0990432 | * | 6/1999 |
| IL | 0990432 | * | 4/2000 |

(Continued)

OTHER PUBLICATIONS

Naptrual85, DIY Overnight Hot Oil Treatment For Shiny Baby Soft Hair, Feb. 26, 2015, YouTube. Available at: https://www.youtube.com/watch?v=olP8nX1akN8 (Accessed: Jan. 16, 2025). (Year: 2015).*

(Continued)

*Primary Examiner* — Eric J Rosen
(74) *Attorney, Agent, or Firm* — Craig R. Miles; CR MILES P.C.

(57) ABSTRACT

A hair treatment apparatus including a pliable sheet having a width and length positionable on a head of a wearer to engage a hairline between an arcuate top edge and an arcuate bottom edge with a pair of ends correspondingly disposed on opposite sides of a wearer's head and methods of using a hair treatment apparatus.

13 Claims, 11 Drawing Sheets

(56) References Cited

U.S. PATENT DOCUMENTS

| | | | | | |
|---|---|---|---|---|---|
| 2,261,274 | A * | 11/1941 | Owen | A45D 44/12 | 2/174 |
| 2,435,100 | A | 1/1948 | Rasmussen | | |
| 2,599,152 | A | 6/1952 | Bartfay | | |
| 2,640,198 | A | 6/1953 | Mullen | | |
| 2,729,823 | A | 1/1956 | Foster | | |
| 2,806,224 | A * | 9/1957 | Kursh | A45D 44/08 | 2/174 |
| 2,987,730 | A | 6/1961 | Walker | | |
| 3,050,071 | A | 8/1962 | Hall | | |
| 3,131,400 | A * | 5/1964 | Blanchard | A42B 1/12 | D2/894 |
| 3,197,787 | A * | 8/1965 | Toguan | A42B 1/08 | 132/53 |
| 3,241,155 | A * | 3/1966 | Phillips | A45D 44/12 | 2/9 |
| 3,261,027 | A | 7/1966 | Lambert | | |
| 3,357,027 | A * | 12/1967 | Feil | A42B 1/041 | 2/209.3 |
| 3,388,708 | A | 6/1968 | Hudson | | |
| 3,529,308 | A | 9/1970 | McBride | | |
| 3,746,015 | A | 7/1973 | Schulman | | |
| 4,223,407 | A | 9/1980 | Zappala | | |
| 4,368,545 | A | 1/1983 | Seidman | | |
| 4,481,680 | A | 11/1984 | Mason et al. | | |
| 4,856,535 | A | 8/1989 | Forbes | | |
| 4,958,385 | A * | 9/1990 | Rushton, Jr. | A45D 44/12 | 2/DIG. 11 |
| 4,964,175 | A * | 10/1990 | Taylor | A45D 8/40 | 2/DIG. 11 |
| 5,023,954 | A * | 6/1991 | Lyons | A61F 11/06 | 2/209 |
| 5,133,371 | A | 7/1992 | Sivess | | |
| 5,423,091 | A | 6/1995 | Lange | | |
| 5,551,455 | A | 9/1996 | Spatola | | |
| 5,845,654 | A | 12/1998 | Johnson | | |
| 6,012,171 | A | 1/2000 | Altman | | |
| 6,012,464 | A * | 1/2000 | Hollowell | A45D 7/045 | 132/202 |
| 6,311,698 | B1 | 11/2001 | Vaughn | | |
| 6,560,784 | B2 * | 5/2003 | Hill | A42B 1/041 | 2/204 |
| 6,584,984 | B2 | 7/2003 | Kelly | | |
| 2002/0023285 | A1 * | 2/2002 | Mosely | A45D 44/12 | 132/212 |
| 2005/0108808 | A1 | 5/2005 | Grinage | | |
| 2006/0143787 | A1 | 7/2006 | Echols | | |
| 2007/0157944 | A1 | 7/2007 | Catron et al. | | |
| 2008/0168594 | A1 | 7/2008 | Bratton | | |
| 2008/0178902 | A1 | 7/2008 | Moeszinger | | |
| 2009/0031476 | A1 | 2/2009 | Ciesinski et al. | | |
| 2009/0100558 | A1 * | 4/2009 | Smith | A45D 44/12 | 602/41 |
| 2009/0165188 | A1 * | 7/2009 | Nies | A45D 44/12 | 132/212 |
| 2010/0031410 | A1 * | 2/2010 | Clark | A45D 44/12 | 2/9 |
| 2010/0138979 | A1 * | 6/2010 | Thompson | A45D 44/12 | 2/174 |
| 2010/0154100 | A1 | 6/2010 | Shao | | |
| 2013/0019889 | A1 | 1/2013 | Palmer-Rogers | | |
| 2013/0042878 | A1 | 2/2013 | Coufos | | |
| 2013/0087164 | A1 * | 4/2013 | Thomas | A45D 44/00 | 132/214 |
| 2014/0020703 | A1 | 1/2014 | Tiram | | |
| 2015/0033443 | A1 | 2/2015 | Hunter | | |
| 2018/0310694 | A1 * | 11/2018 | Yepremian | A41D 15/04 | |
| 2019/0320774 | A1 * | 10/2019 | LaRoche | A61K 8/0216 | |

FOREIGN PATENT DOCUMENTS

| | | |
|---|---|---|
| KR | 101453337 | 10/2014 |
| KR | 101453339 | 10/2014 |
| WO | WO 2005/025350 A1 | 3/2005 |
| WO | WO 2009/143612 A1 | 12/2009 |

OTHER PUBLICATIONS

Beck, Y., My Top 3 Edge Controls For Natural Hair, Apr. 29, 2016, YouTube. Available at: https://www.youtube.com/watch?v=hyU3ab6ifqo (Accessed: Jan. 16, 2025). (Year: 2016).*

Abakah, A., Keys to the perfect short hair mold, Sep. 15, 2016, YouTube. Available at: https://www.youtube.com/watch?v=iDy1_m7HFUk (Accessed: Jan. 16, 2025). (Year: 2016).*

The Cut Life, How to: Mold Your Short Hair: Tutorial 101, Feb. 6, 2016, YouTube. Available at: https://www.youtube.com/watch?v=EH4DpdsIKvw&t=519s (Accessed: Jan. 16, 2025). (Year: 2016).*

Lucas, Brandy, How to Prepare Your Short Hair Cut for Bed, Jan. 15, 2020, YouTube. Available at: https://www.youtube.com/watch?v=dLy_enbdYaY (Accessed: Jan. 16, 2025). (Year: 2020).*

Abakah, A, Short Hair Morning Routine, Aug. 6, 2021, YouTube. Available at: https://www.youtube.com/watch?v=giWXLCe3xzo (Accessed: Jan. 16, 2025). (Year: 2021).*

Is Satin or Silk Better, Satin Serenity. Available at: https://www.satinserenity.com/pages/is-satin-or-silk-better#:~:text=Satin%20is20non%2Dabsorbent%2C%20and,warms%20up%20with%20body%20heat. (Accessed Jan. 17, 2025) (Year: 2025).*

* cited by examiner

HAIR TREATMENT SYSTEM

I. FIELD OF THE INVENTION

A hair treatment apparatus including a pliable sheet having a width and length positionable on a head of a wearer to engage a hairline between an arcuate top edge and an arcuate bottom edge with a pair of ends correspondingly disposed on opposite sides of a head of a wearer and methods of using a hair treatment apparatus.

II. BACKGROUND OF THE INVENTION

Treating hair involves applying a hair treatment composition to the shafts and roots of the hairs on a scalp. Hairs along the hairline can be shorter than the hairs on the remainder of the scalp and may positionally avoid contact with the hair treatment composition by extending up or away from the scalp, and consequently, away from the hair treatment composition. When the hairs along the hairline extend up or away from the scalp, the resulting effect can be non-uniform treatment of the hairs on the scalp, with untreated or partially treated hairs occurring along the hairline. Therefore, an advantage can be provided by the instant inventive apparatuses and methods which positionally maintain the hairs along the hairline in contact with the hair treatment composition resulting in greater uniformity of treatment of all the hairs on a scalp.

III. SUMMARY OF THE INVENTION

Accordingly, a broad object of the present invention can be to provide a hair treatment apparatus including one or more of: a pliable sheet having a width defined by an arcuate top edge and an arcuate bottom edge and a length disposed between a pair of ends, the pliable sheet positionable on a head of a wearer to engage a hairline between the arcuate top edge and the arcuate bottom edge and the pair of ends disposed on opposite sides of the head of the wearer.

Another broad object of the present invention can be to provide a method of making a hair treatment apparatus including one or more of: obtaining a pliable sheet of material, cutting said sheet of material to a width disposed between an arcuate top edge opposite an arcuate bottom edge and to a length arcuately extending between a pair of ends, whereby said pliable sheet has a configuration positionable on the head of a wearer to engage a hairline between the arcuate top edge and the arcuate bottom edge with a pair of ends disposed on opposite sides of the head of the wearer.

Another broad object of the present invention can be to provide a method of hair treatment, including one or more of: applying a hair treatment composition to hairs on a scalp, obtaining a hair treatment apparatus including a pliable sheet having a width defined by an arcuate top edge and an arcuate bottom edge and a length disposed between a pair of ends; positioning the hair treatment apparatus overlaying a hairline of the scalp between the arcuate top edge and the arcuate bottom edge of the pliable sheet, and disposing the pair of ends on opposite sides of the head of the wearer, and removing the hair treatment apparatus from the hairline of the scalp of the wearer.

Another broad object of the present invention can be to provide a kit for a hair treatment including one or more of: a hair treatment apparatus including one or more of a pliable sheet having a width defined by an arcuate top edge and an arcuate bottom edge and a length arcuately extending between a pair of ends, the pliable sheet positionable on a head of a wearer to engage a hairline between the arcuate top edge and the arcuate bottom edge and dispose a pair of ends on opposite sides of the head of a wearer, and a hair treatment composition.

Naturally, further objects of the invention are disclosed throughout other areas of the specification, drawings, photographs, and claims.

IV. BRIEF DESCRIPTION OF THE DRAWINGS

V. DETAILED DESCRIPTION OF THE INVENTION

Figure 1:
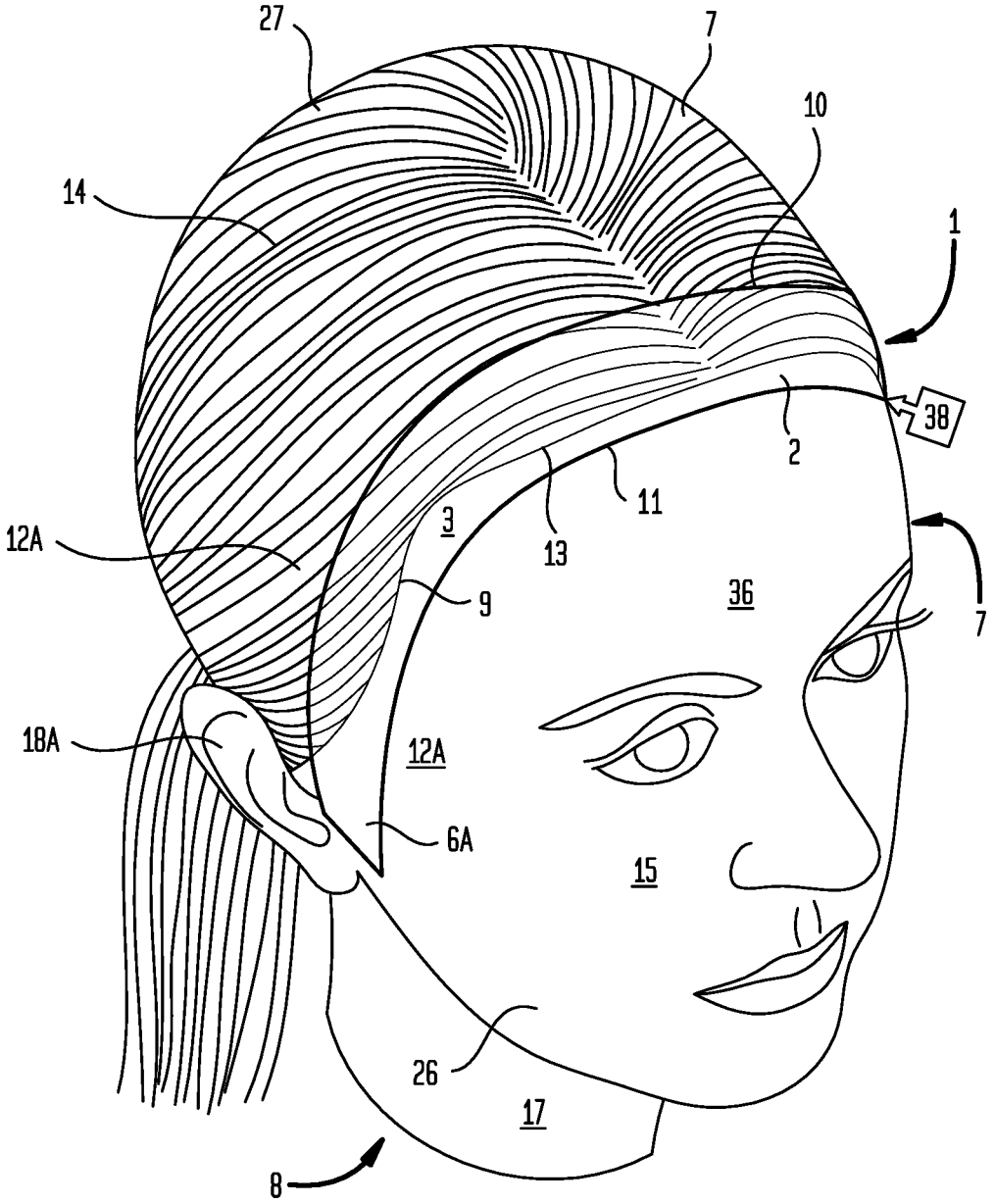
FIG. 1 is a perspective view of a particular embodiment of a hair treatment apparatus disposed on a wearer.
Figure 2:
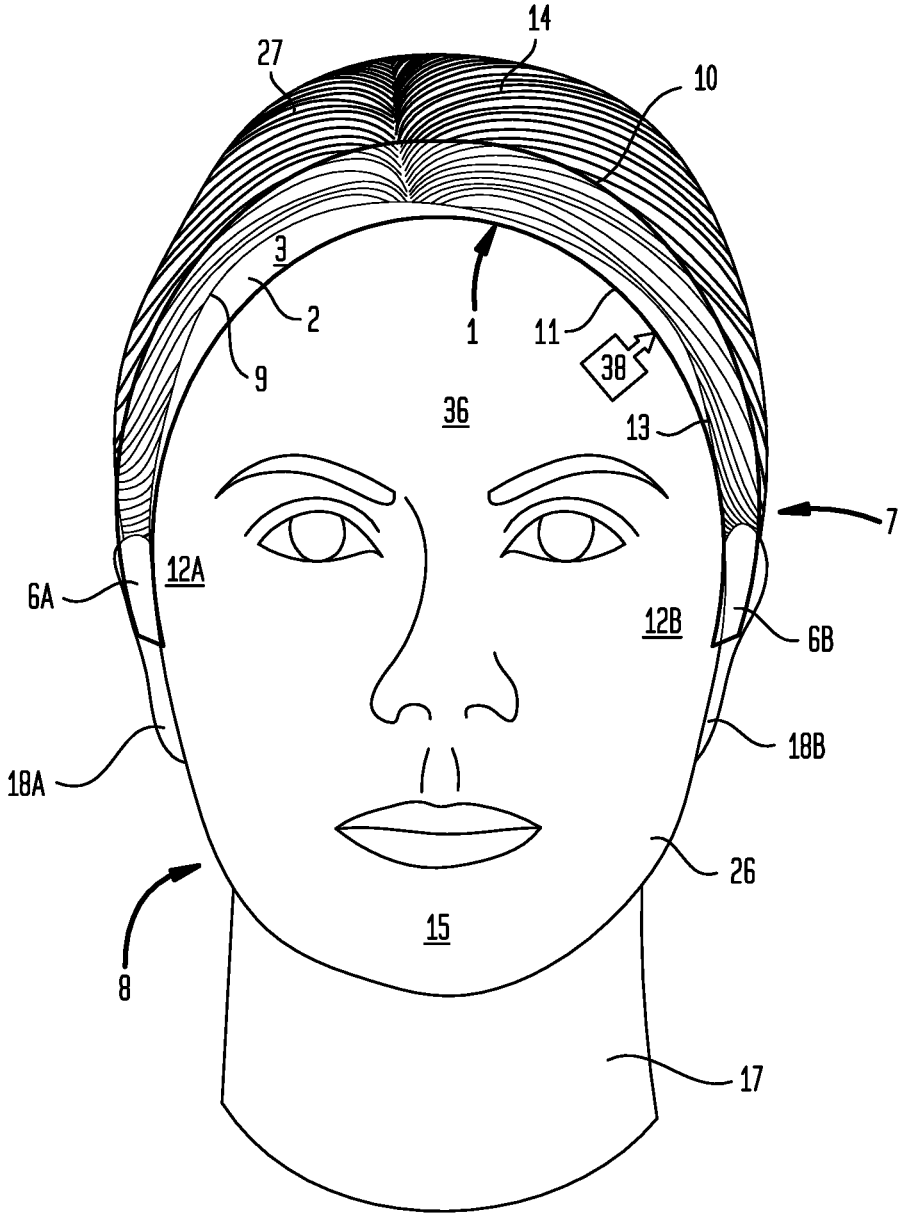
FIG. 2 is a front view of the particular embodiment of a hair treatment apparatus disposed on a wearer.
Figure 3:
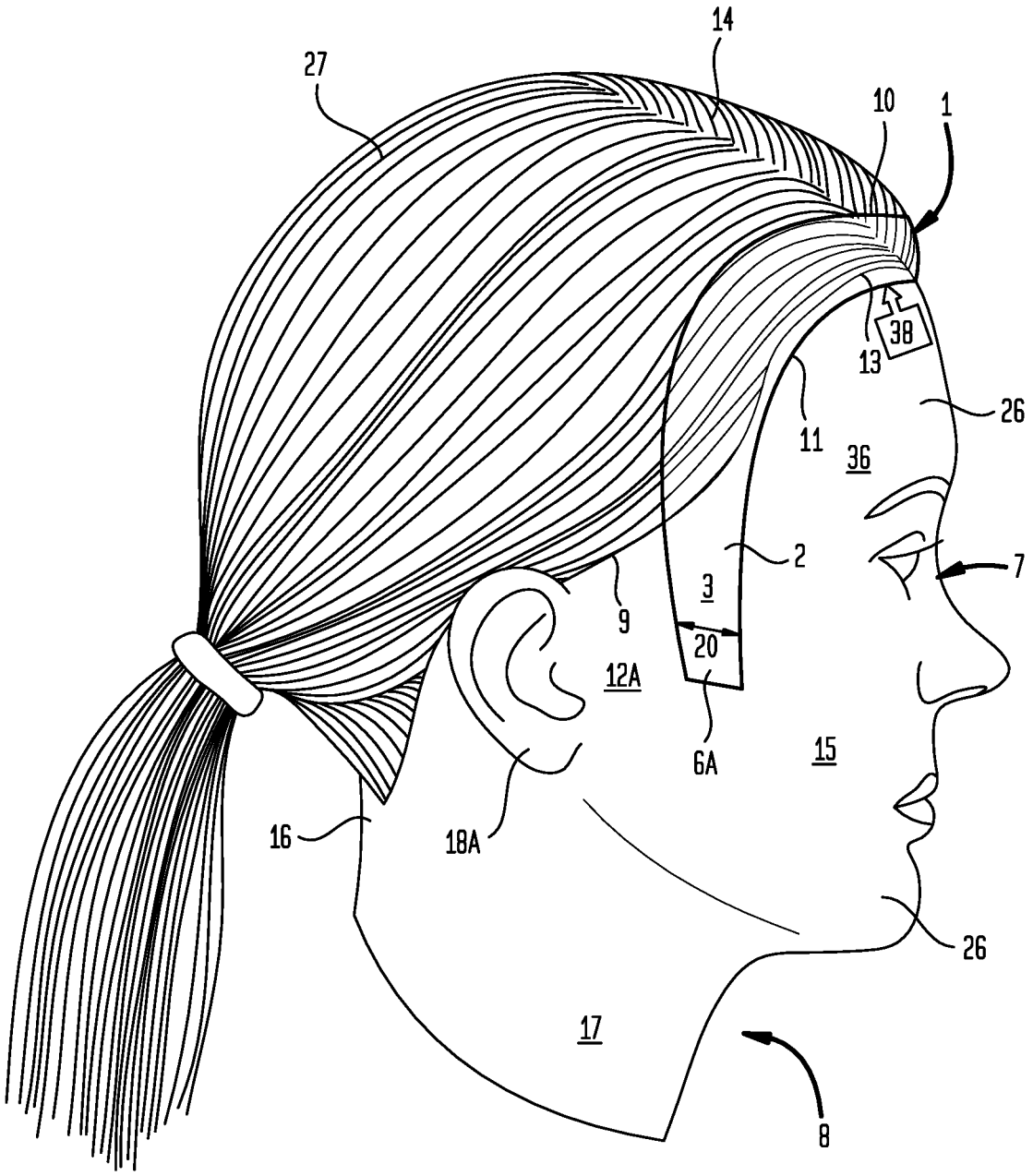
FIG. 3 is a side view of the particular embodiment of a hair treatment apparatus disposed on a wearer having the pair of ends disposed in front of the ears of the wearer.

Referring generally to FIGS. 1 through 12, particular embodiments of a hair treatment apparatus (1) can include a pliable sheet (2). having a first face (3) opposite a second face (4) extending between an arcuate top edge (10) and an arcuate bottom edge (11) and having an arcuate length (5) disposed between a pair of ends (6A)(6B). For purposes of this invention, the term "pliable" means capable of being easily bent, flexible, capable of being repeatedly bent without breaking to conform to the contour of a surface. The pair of ends (6A)(6B) can be orthogonal to the arcuate bottom edge (11) and arcuate top edge (10), as exemplified in FIG. 7, to convergingly or divergingly taper from the arcuate bottom edge (11) and arcuate top edge (10), or be arcuate, or a combination thereof.

Now referring primarily to FIGS. 1 through 6 and 13, the pliable sheet (2) can be positionable on a head (7) of a wearer (8) to engage a hairline (9) of the wearer (8) between the arcuate top edge (10) and the arcuate bottom edge (11) with a pair of ends (6A)(6B) correspondingly disposed on opposite sides (12A)(12B) of the head (7). For purposes of this invention, the term "hairline" can be defined as the edge of the hair (13) on the scalp (14), where the "scalp" is the portion of the head (7) covered in skin excepting the face (15). In particular embodiments, the pair of ends (6A)(6B) can be disposed in front of a pair of ears (18A)(18B), as exemplified in FIGS. 1 through 3. In further particular embodiments, the pair of ends (6A)(6B) can be disposed behind a pair of ears (18A)(18B), as exemplified in FIG. 4. In particular embodiments, the pair of ends (6A)(6B) can, but need not necessarily, be disposed on opposite sides (12A)(12B) of a head (7), circumnavigating the hairline (9) of the scalp (14), and coupling at the nape (16) of the neck (17), as exemplified in FIG. 13.

Figure 7:
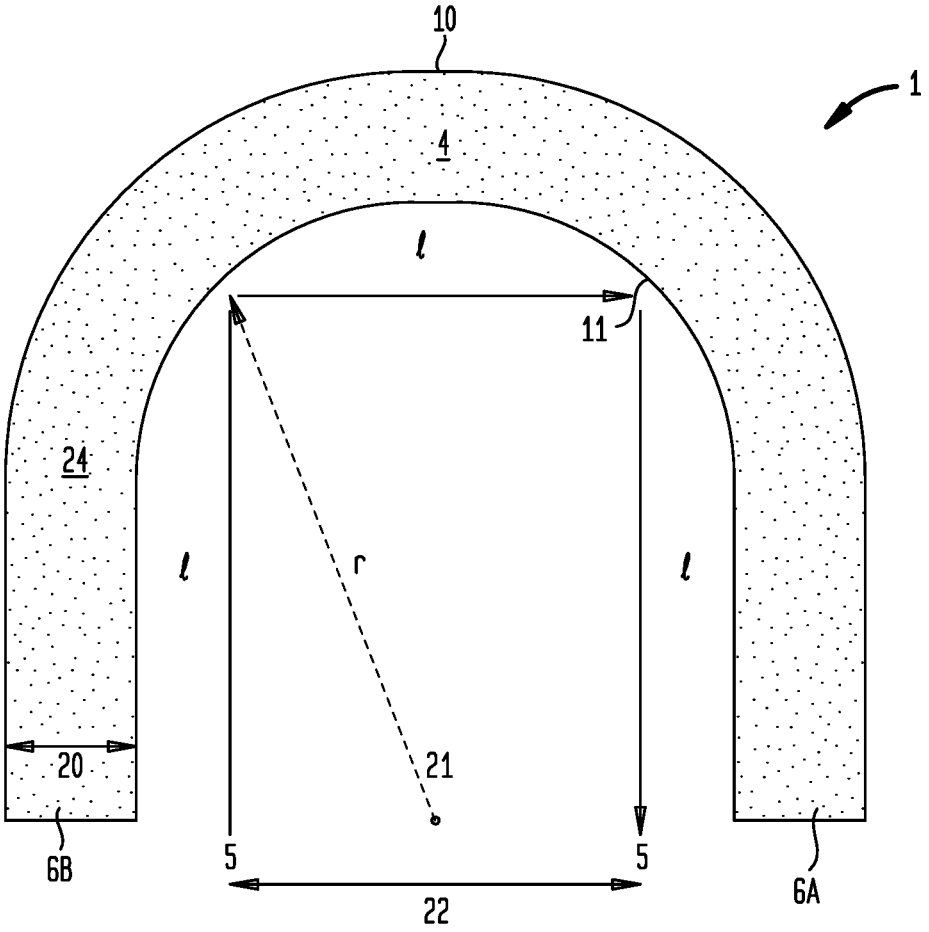
FIG. 7 is a first face view of a particular embodiment of a hair treatment apparatus.
Figure 8:
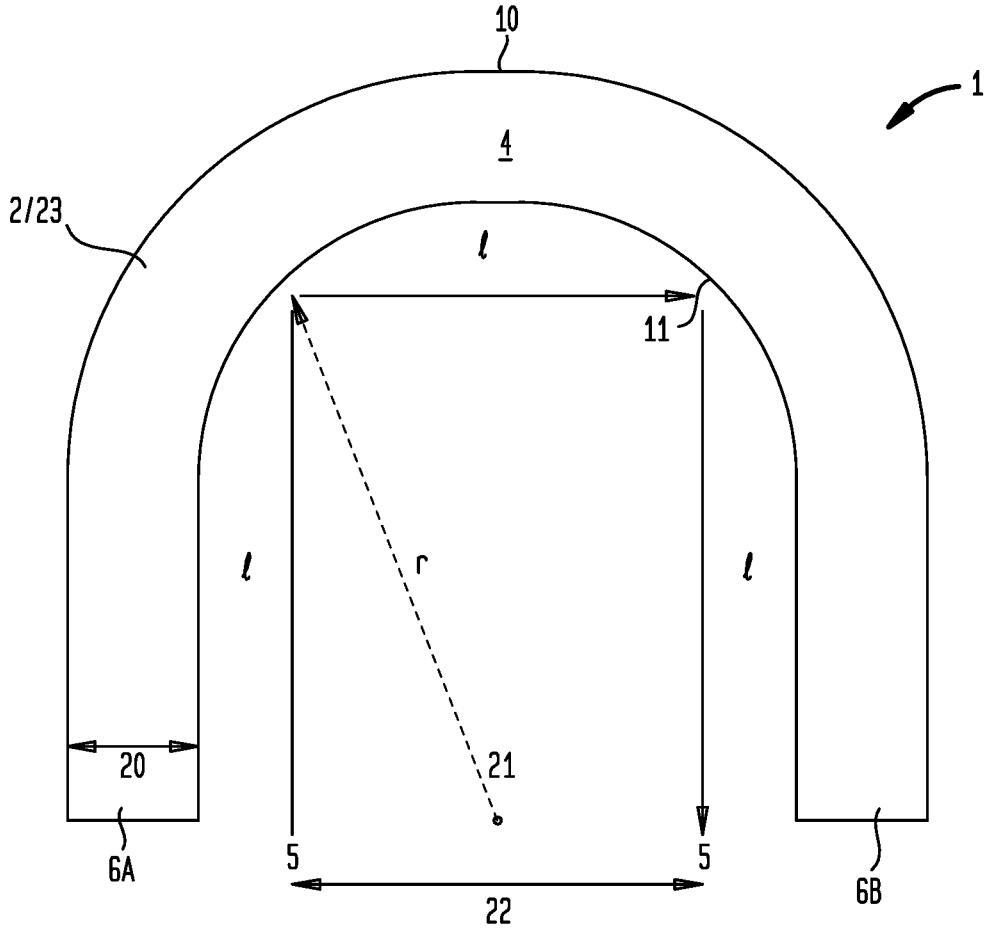
FIG. 8 is a second face view of a particular embodiment of a hair treatment apparatus.
Figure 9:
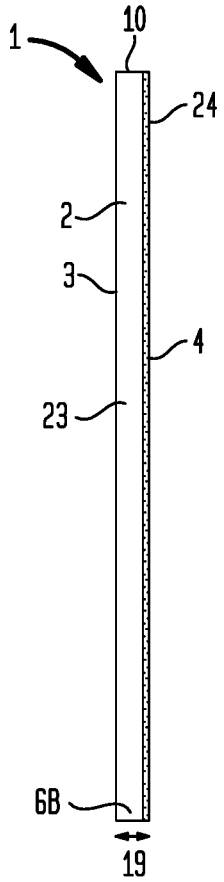
FIG. 9 is a first side view of a particular embodiment of a hair treatment apparatus.
Figure 10:
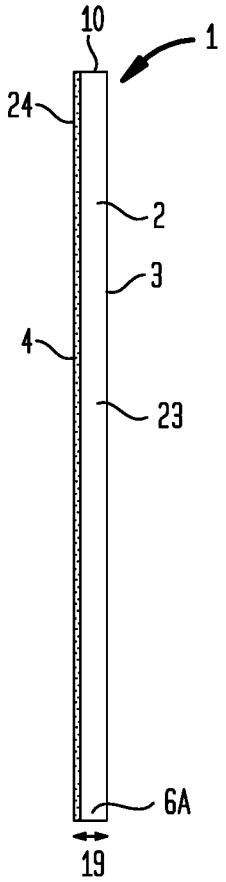
FIG. 10 is a second side view of a particular embodiment of a hair treatment apparatus.
Figure 11:
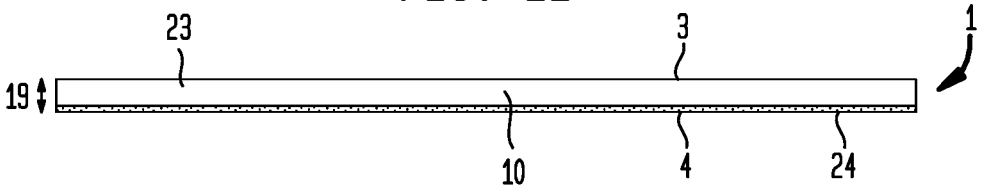
FIG. 11 is a top view of a particular embodiment of a hair treatment apparatus.
Figure 12:
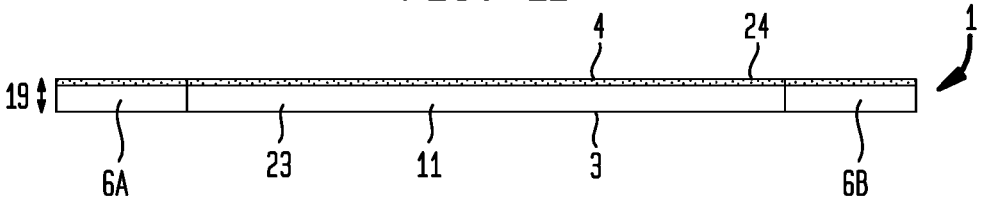
FIG. 12 is a bottom view of a particular embodiment of a hair treatment apparatus.

Now referring primarily to FIGS. 7 and 8, particular embodiments of the pliable sheet (2) can have a width (20) between an arcuate top edge (10) and an arcuate bottom edge (11). In particular embodiments, the width (20) of the pliable sheet (2) can be between about 1 inch to about 4 inches. Moreover, the width (20) of the pliable sheet (2) can be selected from the group including or consisting of: about 1.1 inches to about 1.5 inches, about 1.25 inches to about 1.75 inches, about 1.5 inches to about 2.0 inches, about 1.75 inches to about 2.25 inches, about 2.0 inches to about 2.5 inches, about 2.25 inches to about 2.75 inches, about 2.5 inches to about 3.0 inches, about 2.75 inches to about 3.25 inches, about 3.0 inches to about 3.5 inches, about 3.25 inches to about 3.75 inches, and about 3.5 inches to about 3.9 inches, and combinations thereof.

Again, referring primarily to FIGS. 7 and 8, in particular embodiments, the arcuate bottom edge (11) can define a radius (21). The radius (21) can be about 2 inches to about 5 inches. In further particular embodiments, the radius (21) can be selected from the group consisting of about 2.1 inches to about 2.5 inches, about 2.25 inches to about 2.75 inches, about 2.5 inches to about 3.0 inches, about 2.75 inches to about 3.25 inches, about 3.0 inches to about 3.5 inches, about 3.25 inches to about 3.75 inches, about 3.5 inches to about 4.0 inches, about 3.75 inches to about 4.25 inches, about 4.0 inches to about 4.5 inches, about 4.25 inches to about 4.75 inches, about 4.5 inches to about 4.9 inches, and combinations thereof.

Again, referring primarily to FIGS. 7 and 8, the arcuate bottom edge (11) at the pair of ends (6A)(6B) can be disposed a distance (22) apart. The distance (22) can be about 4 inches to about 10 inches. In further particular embodiments, the distance (22) can be selected from the group consisting of about 4.1 inches to about 4.5 inches, about 4.25 inches to about 4.75 inches, about 4.5 inches to about 5.0 inches, about 4.75 inches to about 5.25 inches, about 5.0 inches to about 5.5 inches, about 5.25 inches to about 5.75 inches, about 5.5 inches to about 6.0 inches, about 5.75 inches to about 6.25 inches, about 6.0 inches to about 6.5 inches, about 6.25 inches to about 6.75 inches, about 6.5 inches to about 7.0 inches, about 6.75 inches to about 7.25 inches, about 7.0 inches to about 7.5 inches, about 7.25 inches to about 7.75 inches, about 7.5 inches to about 8.0 inches, about 7.75 inches to about 8.25 inches, about 8.0 inches to about 8.5 inches, about 8.25 inches to about 8.75 inches, about 8.5 inches to about 9.0 inches, about 8.75 inches to about 9.25 inches, about 9.0 inches to about 9.5 inches, about 9.25 inches to about 9.75 inches, about 9.5 inches to about 9.9 inches, and combinations thereof.

Now referring primarily to FIGS. 9 through 12, particular embodiments of the pliable sheet (2) can further have a thickness (19) of about 0.1 mil to about 100 mils (the term "mil" means a measurement that equals one-thousandth of an inch, or 0.001 inch subject to normal manufacturing variation). In particular embodiments, the thickness (19) can be selected from the group including or consisting of about 0.5 mil to about 5 mil, about 2.5 mil to about 7.5 mil, about 5 mil to about 10 mil, about 7.5 mil to about 12.5 mil, about 10 mil to about 15 mil, about 12.5 mil to about 17.5 mil, about 15 mil to about 20 mil, about 17.5 mil to about 22.5 mil, about 20 mil to about 25 mil, about 22.5 mil to about 27.5 mil, about 25 mil to about 30 mil, about 27.5 mil to about 32.5 mil, about 30 mil to about 35 mil, about 32.5 mil to about 37.5 mil, about 35 mil to about 40 mil, about 37.5 mil to about 42.5 mil, about 40 mil to about 45 mil, about 42.5 mil to about 47.5 mil, about 45 mil to about 50 mil, about 47.5 mil to about 52.5 mil, about 50 mil to about 55 mil, about 52.5 mil to about 57.5 mil, about 55 mil to about 60 mil, about 57.5 mil to about 62.5 mil, about 60 mil to about 65 mil, about 62.5 mil to about 67.5 mil, about 65 mil to about 70 mil, about 67.5 mil to about 72.5 mil, about 70 mil to about 75 mil, about 72.5 mil to about 77.5 mil, about 75 mil to about 80 mil, about 77.5 mil to about 82.5 mil, about 80 mil to about 85 mil, about 82.5 mil to about 87.5 mil, about 85 mil to about 90 mil, about 87.5 mil to about 92.5 mil, about 90 mil to about 95 mil, about 92.5 mil to about 97.5 mil, about 95 mil to about 99.5 mil, and combinations thereof.

Now referring primarily to FIGS. 7 through 12, in particular embodiments, the pliable sheet (2) can be a substantially impermeable pliable sheet (23). For the purposes of this invention, the term "impermeable" means not allowing hair treatment compositions to pass from the first face (3) to the second face (4). Examples of substantially impermeable pliable sheet (23) material can include or consist of: polyethylene, polypropylene, nylon, polystyrene, polyester, or other like material, or combinations thereof. In further particular embodiments, a substantially impermeable layer (24) can be coupled, whether directly or indirectly, to the first or second face (3)(4) of the pliable sheet (2). Examples of the substantially impermeable layer (24) can include or consist of: wax, polyethylene, polypropylene, nylon, polystyrene, polyester, or other like material.

Figure 6:
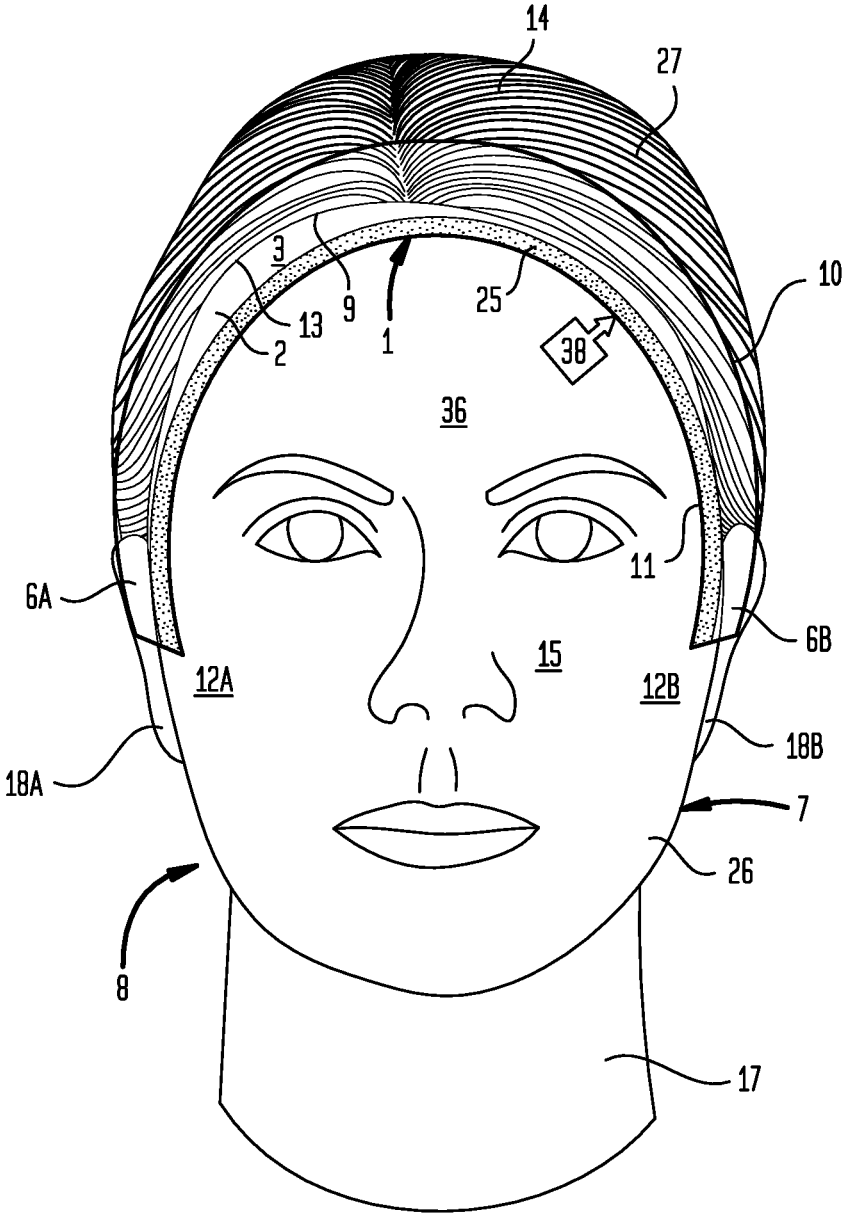
FIG. 6 is a front view of another particular embodiment of a hair treatment apparatus disposed on a wearer.

Now referring primarily to FIG. 6, particular embodiments of a hair treatment apparatus (1) but need not necessarily include an adhesion strip (25) coupled proximate the arcuate top edge (10) or the arcuate bottom edge (11) of the pliable sheet (2). The adhesion strip (25) can be removably adhered to a dermis (26) or hairs (27) of a wearer (8). The adhesion strip (25) can be integrated to the hair treatment apparatus (1) as one piece or can be discrete from the pliable sheet (2) and coupled to the pliable sheet (2) prior to use. The adhesion strip (25) one-piece with the pliable sheet can include or consist of: ethyl-vinyl acetate, silicone, rubber, double-sided tape, silicone caulk, or other like material, or combinations thereof. The adhesion strip (25) as a discrete element can include or consist of: petroleum jelly, liquid latex, vinyl acetate, or other like material, or combinations thereof.

Figure 4:
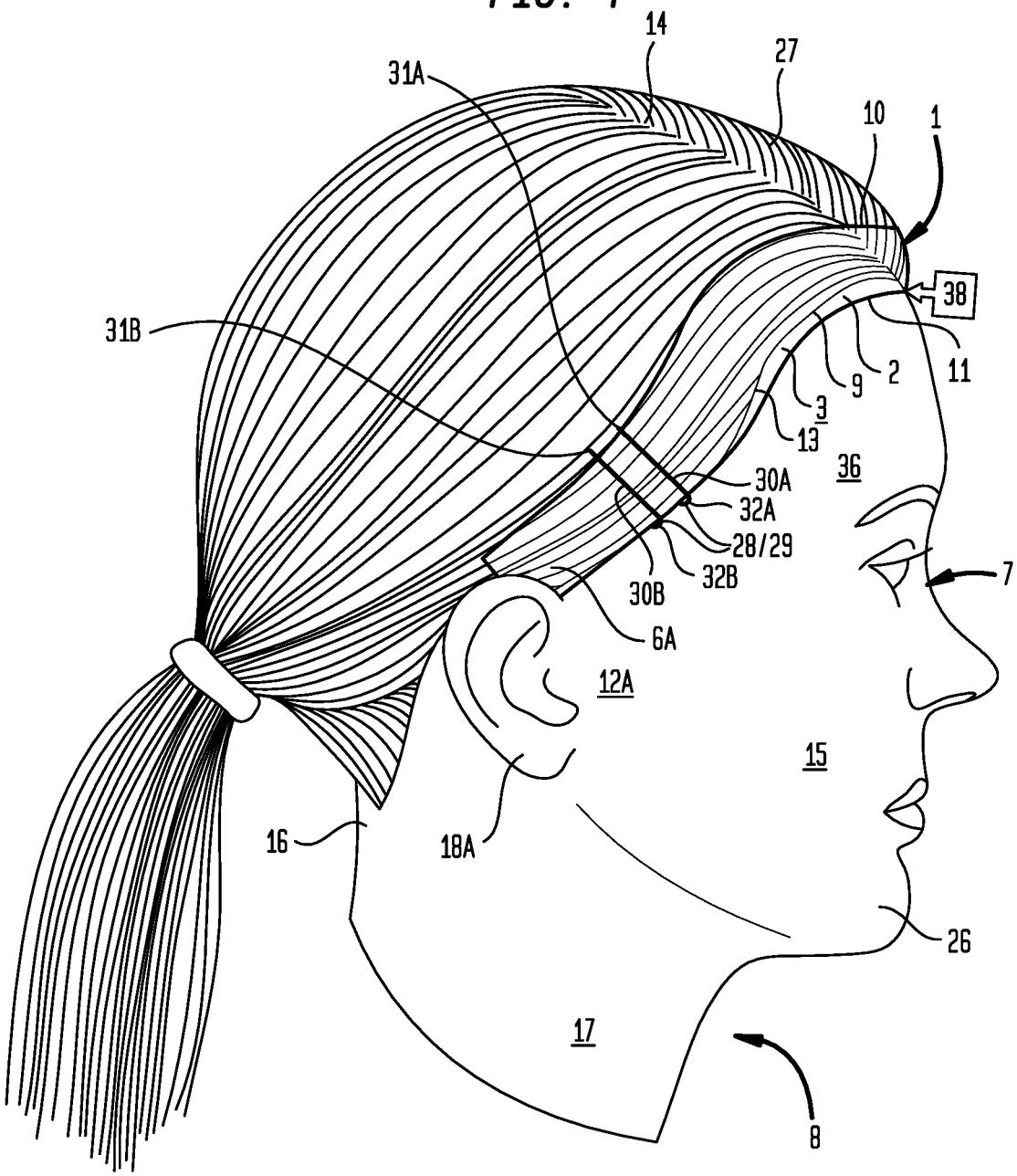
FIG. 4 is a side view of the particular embodiment of a hair treatment apparatus disposed on a wearer having the pair of ends disposed between the ears and the scalp of the wearer.
Figure 5:
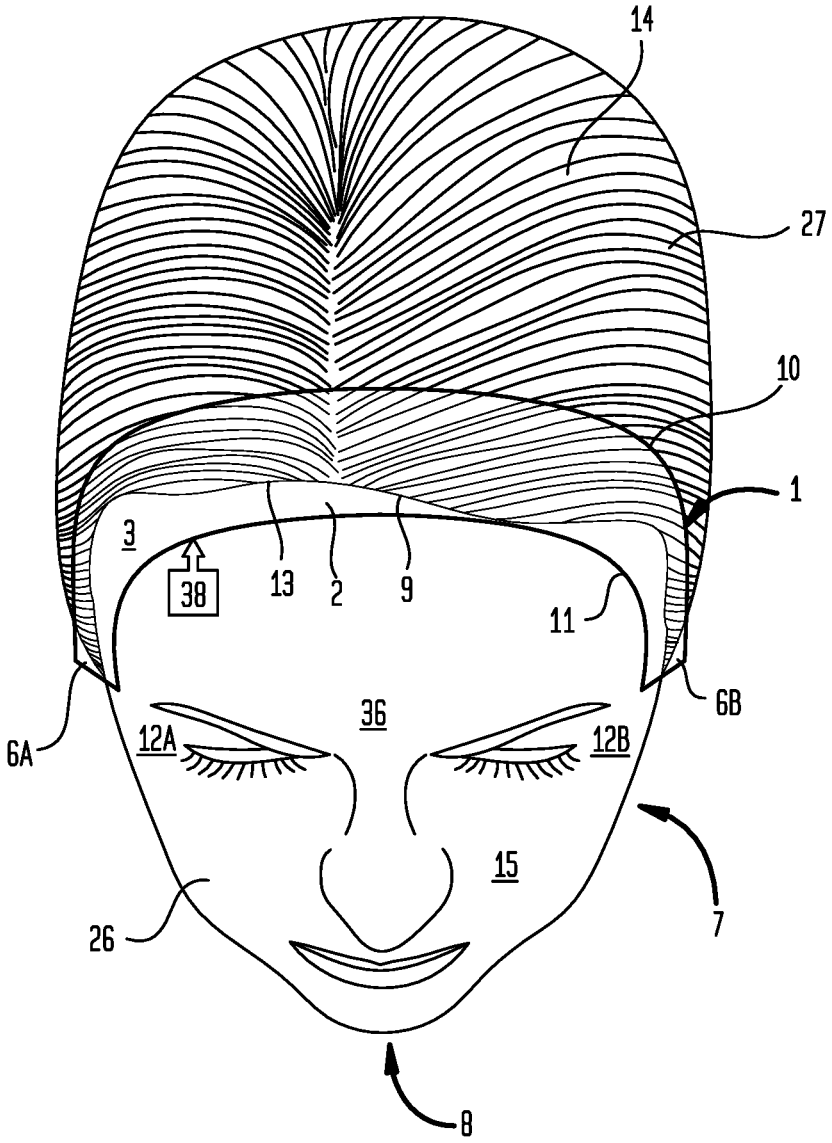
FIG. 5 is a top view of the particular embodiment of a hair treatment apparatus of FIGS. 1 through 3 disposed on a wearer.

Now referring primarily to FIG. 4, particular embodiments of a hair treatment apparatus (1) can, but need not necessarily, include one or more mechanical fasteners (28) secured or removably secured to the pliable sheet (2). The mechanical fasteners (28) can be removably engaged to the hairs (27) of the wearer (8). The mechanical fasteners (28) can include or consist of: barrettes, clips, alligator clips, banana clips, bobby pins (29), or other like mechanical fasteners or combinations thereof. By way of example, the mechanical fastener (28) can include a first and a second resiliently flexible securement elements (30A)(30B) disposed in opposed relation, each of the two resiliently flexible securement elements (30A)(30B) having a length disposed between a first end (31A)(31B) and a second end (32A)(32B). The second ends (32A)(32B) can be joined and the first ends (31A)(31B) can remain uncoupled, thereby allowing the first resiliently flexible securement element (30A) to be disposed adjacent the scalp (14) and the first face (3) of the hair treatment apparatus (1), and the second resiliently flexible securement element (30B) can be disposed adjacent the second face (4) of the hair treatment apparatus (1), where hairs (27) and a portion of the hair treatment apparatus (1) can be disposed between the first and second resiliently flexible securement elements (30A)(30B).

Figure 13:
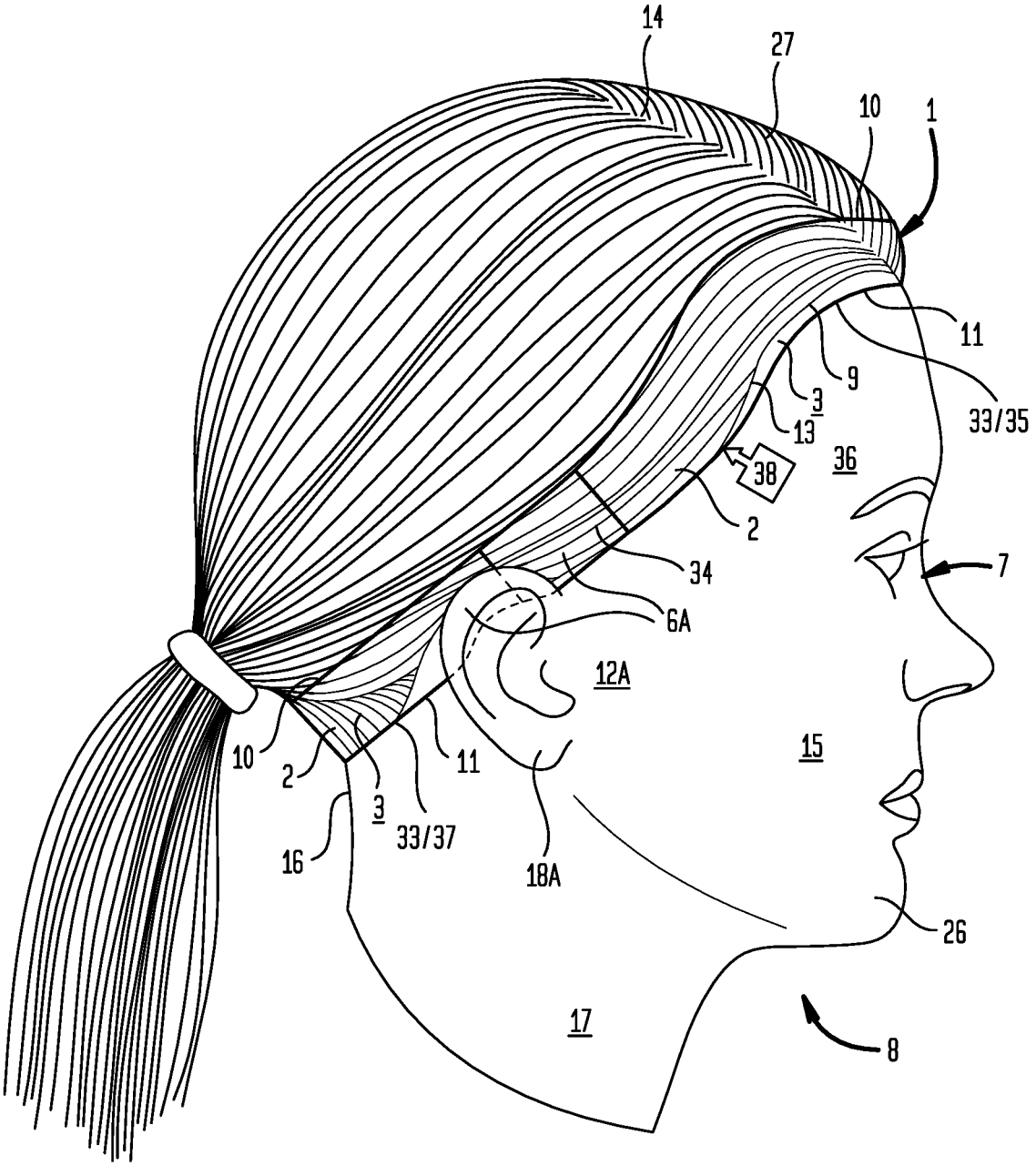
FIG. 13 is a particular embodiment of a plurality of hair treatment apparatuses disposed on a wearer.

Now referring to FIG. 13, particular embodiments of a hair treatment apparatus (1) can further include a plurality of hair treatment apparatuses (33). Each of the plurality of hair treatment apparatuses (33) can have a second face (4) which can overlay a hairline (9) of a scalp (14). Corresponding first and second faces (4) of each of the plurality of hair treatment apparatuses (33) can be disposed in an overlapping configuration (34) where at least a portion of the second face (4) of each of the plurality of hair treatment apparatuses (33) can be engaged to the hairline (9). By way of example, an overlapping configuration (34) for a plurality of hair treatment apparatuses (33) can include a second face (4) of a first hair treatment apparatus (35) disposed along the portion of the hairline (9) including the forehead (36) and behind a pair of ears (18A)(18B). A second face (4) of a second hair treatment apparatus (37) can be disposed to have a portion overlapping the first face (3) proximate one of the pair of ends (6A)(6B) of the first hair treatment apparatus (35), and the remaining portion can be disposed behind the pair of ears (6A)(6B) and along the hairline (9) towards the nape (16) of the neck (17).

Now referring to FIGS. 1 through 6, particular methods of using a hair treatment apparatus (1) can include one or more of: applying a hair treatment composition (38) to a scalp (14), overlaying a hairline (9) of the scalp (14) with a hair treatment apparatus (1), as described above, and removing the hair treatment apparatus (1) from the hairline (9) of the scalp (14). Hair treatment compositions (38) can include or consist of: relaxers, masks, colorants, moisturizers, bleach, or other like compositions. Particular methods can further include obtaining one or more mechanical fasteners (28), as described above, and removably coupling the one or more mechanical fasteners (28) to the pliable sheet (2). In particular embodiments including a plurality of hair treatment apparatuses (33), particular methods can include disposing the second face (4) of each of the plurality of hair treatment apparatuses (33) over a hairline (9) of a scalp (14), where at least a portion of the second face (4) of each of the plurality of hair treatment apparatuses (33) engages the hairline (9), as exemplified in FIG. 13. In further particular embodiments, the plurality of hair treatment apparatuses (33) can be disposed in an overlapping configuration (34), as described above.

Figure 14:
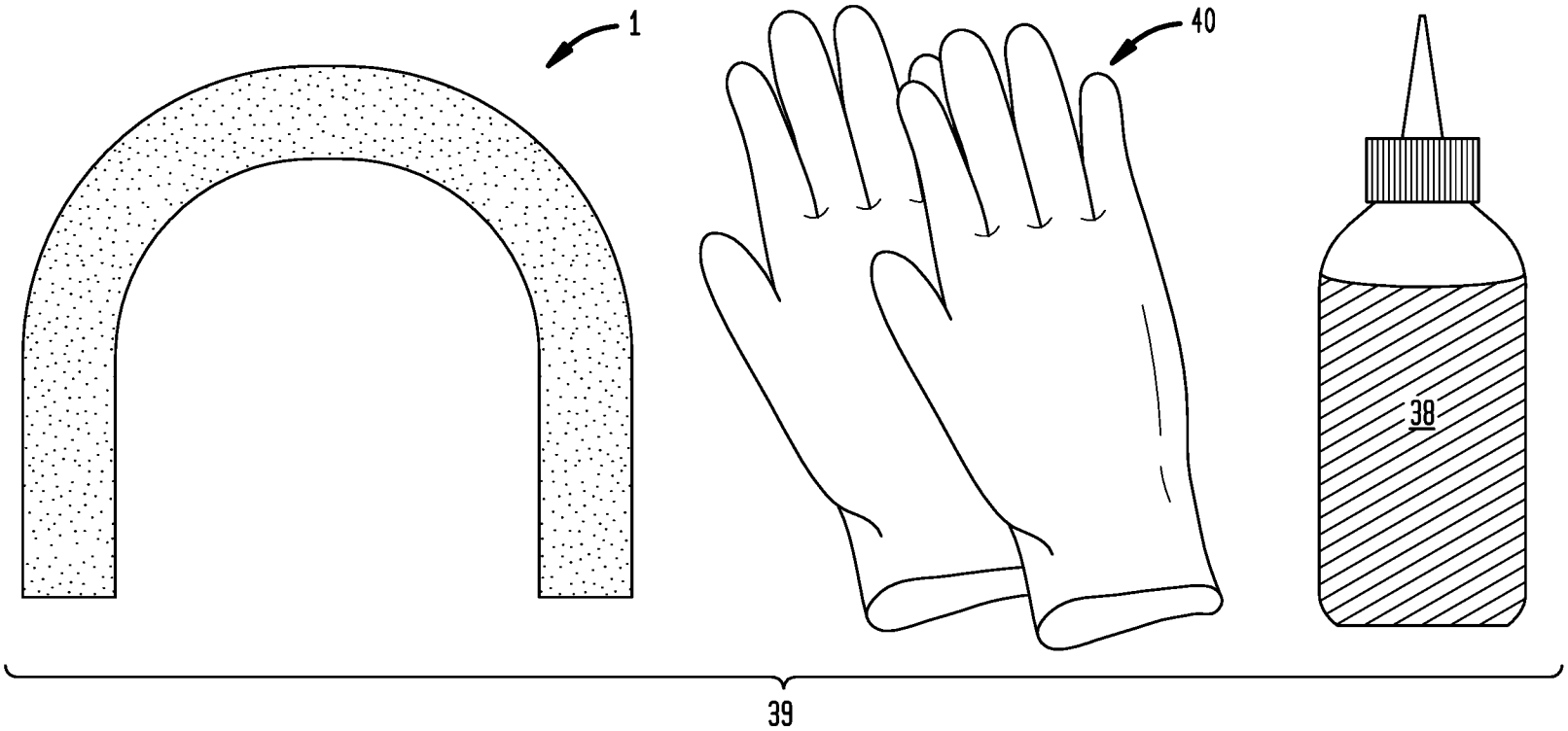
FIG. 14 is a particular embodiment of a kit for a hair treatment.

Now referring to FIG. 14, particular embodiments can provide a kit (39) for a hair treatment. The kit (39) can include a hair treatment composition (38) and a hair treatment apparatus (1) as described above. In further particular embodiments, the kit can further include a pair of gloves (40) substantially impermeable to the hair treatment composition (38). The gloves (40) can be made from one or more of: polyethylene, polypropylene, nylon, polystyrene, polyester, or other like material. As to particular embodiments, the kit (39) may also include a plurality of hair treatment apparatuses (33) and one or more mechanical fasteners (28).

As can be easily understood from the foregoing, the basic concepts of the present invention may be embodied in a variety of ways. The invention involves numerous and varied embodiments of a hair treatment apparatus and methods for making and using such hair treatment apparatuses including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "fastener" should be understood to encompass disclosure of the act of "fastening"—whether explicitly discussed or not—and, conversely, were there effectively disclosure of the act of "fastening", such a disclosure should be understood to encompass disclosure of a "fastener" and even a "means for fastening." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the hair treatment apparatuses herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A hair treatment apparatus, comprising:

a flat substantially impermeable pliable sheet having a first face opposite a second face, said flat substantially impermeable pliable sheet having a width defined by a convex top edge and a concave bottom edge, said arcuate top edge and said arcuate bottom edge define a curved middle portion disposed between two descending portions terminating in a pia r of ends, said concave bottom edge at said pair of ends disposed a distance apart of about 4 inches to about 10 inches, said flat substantially impermeable pliable sheet having a thickness between said first face and said second face to allow said flat impermeable pliable sheet to conform to a scalp of a wearer along a hairline of said wearer, said second face of said flat substantially impermeable pliable sheet, when conformed to said scalp of said wearer, removably contacts said hairline of said wearer between said convex top edge and said concave bottom edge with said pair of ends correspondingly disposed uncoupled from one another on opposite sides of said wearer's head.

2. The hair treatment apparatus of claim 1, wherein said substantially impermeable pliable sheet comprises a material selected from the group consisting of: polyethylene, nylon, polystyrene, and polyester.

3. The hair treatment apparatus of claim 1, wherein said flat substantially impermeable pliable sheet comprises a flat pliable sheet having an impermeable layer coupled to said first or said second face of said flat pliable sheet.

4. The hair treatment apparatus of claim 3, wherein said substantially impermeable layer coupled to said pliable sheet is selected from the group consisting of: wax, polyethylene, polypropylene, nylon, polystyrene, and polyester.

5. The hair treatment apparatus of claim 1, further comprising an adhesion strip coupled proximate said arcuate bottom edge, said adhesion strip capable of removable adhesion to a dermis of said wearer.

6. The hair treatment apparatus of claim 5, further comprising a mechanical fastener coupled to said pliable sheet, said mechanical fastener capable of removably coupling to said hairs of said wearer.

7. The hair treatment apparatus of claim 6, wherein said hair treatment apparatus comprises said width of said flat substantially impermeable pliable sheet between about 1 inch and about 4 inches.

8. The hair treatment apparatus of claim 7, wherein said hair treatment apparatus comprises said width of said pliable sheet selected from the group consisting of: about 1.1 inches to about 1.5 inches, about 1.25 inches to about 1.75 inches, about 1.5 inches to about 2.0 inches, about 1.75 inches to about 2.25 inches, about 2.0 inches to about 2.5 inches, about 2.25 inches to about 2.75 inches, about 2.5 inches to about 3.0 inches, about 2.75 inches to about 3.25 inches, about 3.0 inches to about 3.5 inches, about 3.25 inches to about 3.75 inches, and about 3.5 inches to about 3.9 inches, and combinations thereof.

9. The hair treatment apparatus of claim 8, wherein said distance apart is selected from the group consisting of: about 4.1 inches to about 4.5 inches, about 4.25 inches to about 4.75 inches, about 4.5 inches to about 5.0 inches, about 4.75 inches to about 5.25 inches, about 5.0 inches to about 5.5 inches, about 5.25 inches to about 5.75 inches, about 5.5 inches to about 6.0 inches, about 5.75 inches to about 6.25 inches, about 6.0 inches to about 6.5 inches, about 6.25 inches to about 6.75 inches, about 6.5 inches to about 7.0 inches, about 6.75 inches to about 7.25 inches, about 7.0 inches to about 7.5 inches, about 7.25 inches to about 7.75 inches, about 7.5 inches to about 8.0 inches, about 7.75 inches to about 8.25 inches, about 8.0 inches to about 8.5 inches, about 8.25 inches to about 8.75 inches, about 8.5 inches to about 9.0 inches, about 8.75 inches to about 9.25 inches, about 9.0 inches to about 9.5 inches, about 9.25 inches to about 9.75 inches, about 9.5 inches to about 9.9 inches, and combinations thereof.

10. The hair treatment apparatus of claim 9, wherein said arcuate bottom edge defines a radius of about 2 inches to about 5 inches.

11. The hair treatment apparatus of claim 10, wherein said radius is selected from the group consisting of: about 2.1 inches to about 2.5 inches, about 2.25 inches to about 2.75 inches, about 2.5 inches to about 3.0 inches, about 2.75 inches to about 3.25 inches, about 3.0 inches to about 3.5 inches, about 3.25 inches to about 3.75 inches, about 3.5 inches to about 4.0 inches, about 3.75 inches to about 4.25 inches, about 4.0 inches to about 4.5 inches, about 4.25 inches to about 4.75 inches, about 4.5 inches to about 4.9 inches, and combinations thereof.

12. The hair treatment apparatus of claim 1, wherein said hair treatment apparatus comprises a plurality of said flat substantially impermeable pliable sheet, wherein said second face of a second of the plurality of substantially impermeable pliable sheets is directly coupled to said first face of a first of said plurality of flat substantially impermeable pliable sheets along its length.

13. The hair treatment apparatus of claim 1, wherein said pair of ends correspondingly disposed uncoupled from one another are configured to be correspondingly disposed on opposite sides of said wearer's head in front of said wearer's pair of ears.

* * * * *